US011315452B2

(12) United States Patent
Ahn et al.

(10) Patent No.: US 11,315,452 B2
(45) Date of Patent: Apr. 26, 2022

(54) DISPLAY APPARATUS AND METHOD OF OPERATING THE SAME

(71) Applicant: Samsung Display Co., Ltd., Yongin-si (KR)

(72) Inventors: Gwang Soo Ahn, Suwon-si (KR); Sung Soo Choi, Anyang-si (KR); Jong Jae Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/069,254

(22) Filed: Oct. 13, 2020

(65) Prior Publication Data

US 2021/0248939 A1 Aug. 12, 2021

(30) Foreign Application Priority Data

Feb. 12, 2020 (KR) ..... 10-2020-0016828

(51) Int. Cl.
*G09G 3/00* (2006.01)
*G09G 3/20* (2006.01)

(52) U.S. Cl.
CPC ..... *G09G 3/006* (2013.01); *G09G 3/2092* (2013.01); *G09G 2310/0275* (2013.01); *G09G 2310/08* (2013.01); *G09G 2330/021* (2013.01); *G09G 2330/08* (2013.01)

(58) Field of Classification Search
CPC .. G09G 5/003; G09G 5/006; G09G 2310/027; G09G 2330/021; G09G 2330/045; G09G 2330/08; G09G 2330/10; G09G 3/2059
See application file for complete search history.

(56) References Cited

U.S. PATENT DOCUMENTS

2018/0061326 A1* 3/2018 Kim ..... G09G 3/3275
2021/0034452 A1* 2/2021 Tan ..... G06F 9/4401

FOREIGN PATENT DOCUMENTS

KR 10-2015-0009208 A 1/2015

* cited by examiner

*Primary Examiner* — Gerald Johnson
(74) *Attorney, Agent, or Firm* — Lewis Roca Rothgerber Christie LLP

(57) ABSTRACT

A display apparatus includes a display panel, a timing controller and a power management integrated circuit (PMIC). The timing controller is to control an operation of the display panel and to store a plurality of fault patterns to be displayed on the display panel to represent that a plurality of defective phenomena have occurred. The PMIC is to supply a first power supply voltage to the timing controller and to monitor whether the plurality of defective phenomena have occurred. When a first defective phenomenon among the plurality of defective phenomena is sensed, the PMIC is to store first fault data and to shut down the display panel. When the first defective phenomenon is sensed, the timing controller is to control the display panel to display a first fault pattern corresponding to the first defective phenomenon among the plurality of fault patterns before the display panel is shut down.

19 Claims, 8 Drawing Sheets

| | |
|---|---|
| FP1 | FOCP |
| FP2 | FZCD |
| FP3 | FTEMP |
| FP4 | FI2C |
| ⋮ | ⋮ |

DISPLAY APPARATUS AND METHOD OF OPERATING THE SAME

CROSS-REFERENCE TO RELATED APPLICATION

This application claims priority to and the benefit of Korean Patent Application No. 10-2020-0016828, filed on Feb. 12, 2020, the entire content of which is hereby incorporated by reference.

BACKGROUND

1. Field

Example embodiments relate generally to displaying images, and more particularly to display apparatuses and methods of operating the display apparatuses.

2. Description of the Related Art

A flat panel display (FPD), which is easy to cover a large area and is able to be thin and lightweight, is widely used as a display apparatus in recent years. The FPD may include, but is not limited to, a liquid crystal display (LCD), a plasma display panel (PDP) and an organic light emitting display (OLED), for example.

Typically, a display apparatus includes a display panel and a timing controller. The display panel displays an image, and the timing controller controls overall operations of the display panel. In addition, the display apparatus may further include a power management integrated circuit (PMIC) to supply power to the timing controller. Defects or faults may occur in the display apparatus due to various causes, and the defects and/or the causes of the defects may be recorded in the display apparatus in case the defects and/or causes of the defects are to be analyzed later.

SUMMARY

Aspects of an example embodiment of the present disclosure are directed toward a display apparatus capable of efficiently analyzing and detecting defects or faults.

Aspects of an example embodiment of the present disclosure are directed toward a method of operating the display apparatus.

According to example embodiments, a display apparatus includes a display panel, a timing controller and a power management integrated circuit (PMIC). The display panel includes a plurality of pixels. The timing controller is to control an operation of the display panel and to store a plurality of fault patterns to be displayed on the display panel. The plurality of fault patterns are to be utilized to represent that a plurality of defective phenomena have occurred while the display panel is driven. The PMIC is to supply a first power supply voltage to the timing controller and to monitor whether the plurality of defective phenomena have occurred. When a first defective phenomenon among the plurality of defective phenomena is sensed, the PMIC is to store first fault data representing that the first defective phenomenon has occurred and to shut down the display panel. When the first defective phenomenon is sensed, the timing controller is to control the display panel to display a first fault pattern corresponding to the first defective phenomenon among the plurality of fault patterns before the display panel is shut down by the PMIC.

In an example embodiment, the timing controller may include a storage, a fault pattern display controller and an image processor. The storage may store the plurality of fault patterns. The fault pattern display controller may read the first fault data representing that the first defective phenomenon has occurred from the PMIC and may read the first fault pattern corresponding to the first defective phenomenon from the storage based on the first fault data when the first defective phenomenon is sensed. The image processor may generate image data corresponding to the first fault pattern.

In an example embodiment, the PMIC may include a power supplier, a sensor and a storage. The power supplier may generate the first power supply voltage based on an external power supply voltage. The sensor may monitor whether the plurality of defective phenomena have occurred. The storage may store the first fault data when the first defective phenomenon is sensed.

In an example embodiment, the timing controller may include a first fault detection pin. The PMIC may include a second fault detection pin. The timing controller may determine whether the first defective phenomenon has occurred by utilizing the first fault detection pin and the second fault detection pin.

In an example embodiment, when the first defective phenomenon is sensed, the PMIC may transition a voltage level of the second fault detection pin from a first level to a second level. The timing controller may check through the first fault detection pin whether the voltage level of the second fault detection pin is at the second level, and may read the first fault data from the PMIC when the voltage level of the second fault detection pin is at the second level.

In an example embodiment, the display apparatus may further include a second PMIC. The second PMIC may include a third fault detection pin and may generate a gate clock signal. The second fault detection pin and the third fault detection pin may be electrically coupled (e.g., connected) to each other such that an operation of shutting down the display panel is synchronized.

In an example embodiment, the timing controller may determine whether the first defective phenomenon has occurred by periodically checking whether the PMIC stores the first fault data.

In an example embodiment, the timing controller may read the first fault data from the PMIC when the PMIC senses the first defective phenomenon and stores the first fault data.

In an example embodiment, the display panel may not be shut down immediately after the first defective phenomenon is sensed. The timing controller may read the first fault data from the PMIC during a first time interval immediately after the first defective phenomenon is sensed. The display panel may display the first fault pattern during a second time interval after the first time interval and may be shut down after the second time interval.

In an example embodiment, the PMIC may shut down the display panel by blocking the first power supply voltage to be supplied to the timing controller.

In an example embodiment, the display apparatus may further include a gate driver. The gate driver may be coupled (e.g., connected) to a plurality of gate lines of the display panel, may generate a plurality of gate signals based on a gate clock signal and may apply the plurality of gate signals to the plurality of gate lines. The PMIC may supply the gate clock signal to the gate driver.

In an example embodiment, the PMIC may shut down the display panel by blocking the gate clock signal to be supplied to the gate driver.

In an example embodiment, the display apparatus may further include a data driver. The data driver may be coupled (e.g., connected) to a plurality of data lines of the display panel, may generate a plurality of data voltages based on output image data provided from the timing controller and may apply the plurality of data voltages to the plurality of data lines. The PMIC may supply a second power supply voltage to the data driver.

In an example embodiment, the PMIC may shut down the display panel by blocking the second power supply voltage to be supplied to the data driver.

In an example embodiment, the plurality of defective phenomena may include at least one selected from among an over-current protection failure, a zero-current detection failure, a temperature failure and a communication failure.

According to example embodiments, in a method of operating a display apparatus, power is supplied to the display apparatus including a display panel, a timing controller and a power management integrated circuit (PMIC). The display panel includes a plurality of pixels. The timing controller controls an operation of the display panel and stores a plurality of fault patterns to be displayed on the display panel. The plurality of fault patterns are to be utilized to represent that a plurality of defective phenomena have occurred while the display panel is driven. It is monitored by the PMIC whether the plurality of defective phenomena have occurred. When a first defective phenomenon among the plurality of defective phenomena is sensed, a first fault pattern among the plurality of fault patterns is displayed on the display panel. The first fault pattern corresponds to the first defective phenomenon. After the first fault pattern is displayed on the display panel, the display panel is shut down.

In an example embodiment, the timing controller may include a first fault detection pin. The PMIC may include a second fault detection pin. The timing controller may determine whether the first defective phenomenon has occurred by utilizing the first fault detection pin and the second fault detection pin.

In an example embodiment, in displaying the first fault pattern on the display panel, when the first defective phenomenon is sensed, first fault data representing that the first defective phenomenon has occurred may be stored into the PMIC. When the first defective phenomenon is sensed, a voltage level of the second fault detection pin may be transitioned from a first level to a second level. It may be checked through the first fault detection pin whether the voltage level of the second fault detection pin is at the second level. When the voltage level of the second fault detection pin is at the second level, the first fault data may be read from the PMIC. The first fault pattern corresponding to the first defective phenomenon may be read based on the first fault data. Image data corresponding to the first fault pattern may be generated and provided to the display panel.

In an example embodiment, the timing controller may determine whether the first defective phenomenon has occurred by periodically checking whether the PMIC stores first fault data representing that the first defective phenomenon has occurred.

In an example embodiment, in displaying the first fault pattern on the display panel, when the first defective phenomenon is sensed, the first fault data may be stored into the PMIC. When the first defective phenomenon is sensed and when the first fault data is stored into the PMIC, the first fault data may be read from the PMIC. The first fault pattern corresponding to the first defective phenomenon may be read based on the first fault data. Image data corresponding to the first fault pattern may be generated and provided to the display panel.

In the display apparatus and the method of operating the display apparatus according to example embodiments, the plurality of fault patterns to represent that the plurality of defective phenomena have occurred may be stored in advance. When at least one selected from among the plurality of defective phenomena is sensed by the monitoring operation while the display panel is driven, a corresponding fault pattern may be displayed before the display panel is shut down. Thus, users and engineers may recognize or identify the type or kind of defects or faults without any additional process. For example, in case of defects in the customer's process, the fault analysis schedule may be shortened and the cost of retrieving the product may be minimized or reduced. In case of defects in the manufacturing process, it may be easy to recognize the type or kind of defects and to calculate the defect rate. Accordingly, the defects or faults may be efficiently analyzed and detected without extra cost.

BRIEF DESCRIPTION OF THE DRAWINGS

The present disclosure will be more clearly understood from the following detailed description taken in conjunction with the accompanying drawings, which illustrate non-limiting example embodiments.

DETAILED DESCRIPTION

Figure 1:
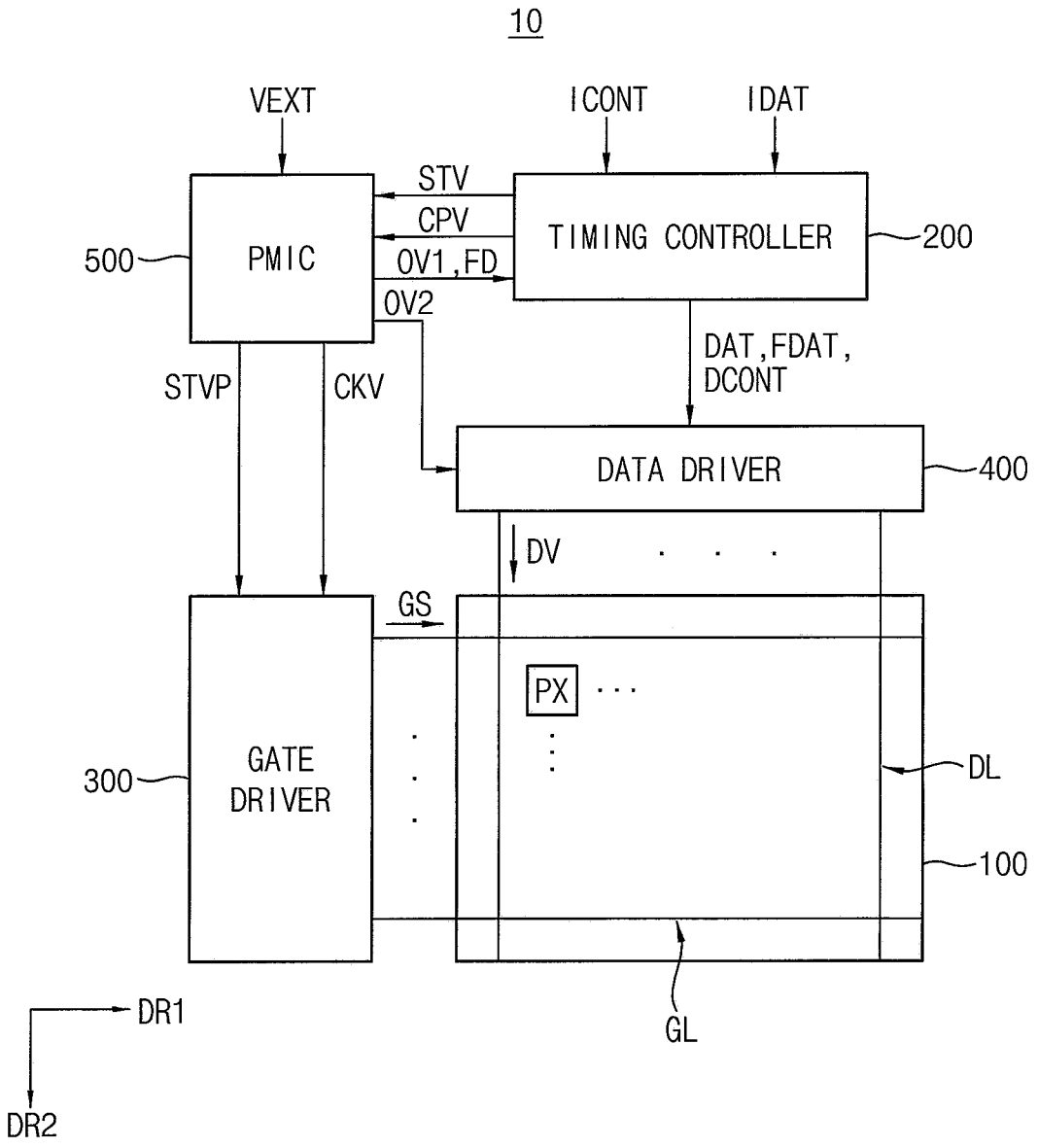
FIG. 1 is a block diagram illustrating a display apparatus according to example embodiments.

Various example embodiments will be described more fully with reference to the accompanying drawings, in which example embodiments are shown. The present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like reference numerals refer to like elements throughout this application. As used herein, the use of the term "may," when describing embodiments of the present disclosure, refers to "one or more embodiments of the present disclosure."

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present disclosure. As used herein, the term "and/or" includes any and all combinations of one or more of the associated listed items. As used herein, the term "substantially," "about," "approximately," and similar terms are used as terms of approximation and not as terms of degree, and are intended to account for the inherent deviations in measured or calculated values that would be recognized by those of ordinary skill in the art.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing the example embodiments and is not intended to limit the present disclosure. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, tasks, operations, elements, and/or components, but do not preclude the presence or addition of one or more other features, integers, tasks, operations, elements, and/or components.

Spatially relative terms, such as "beneath," "below," "lower," "above," "upper" and the like, may be used herein for ease of description to describe one element or feature's relationship to another element(s) or feature(s) as illustrated in the drawings. It will be understood that the spatially relative terms are intended to encompass different orientations of the device in use or operation in addition to the orientation depicted in the drawings. For example, if the device in the drawings is turned over, elements described as "below" or "beneath" other elements or features would then be oriented "above" the other elements or features. Thus, the example term "below" can encompass both an orientation of above and below. The device may be otherwise oriented (e.g., rotated 90 degrees or at other orientations) and the spatially relative descriptors used herein should be interpreted accordingly.

Unless otherwise defined, all terms (including technical and scientific terms) used herein have the same meaning as should be commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It should also be noted that in some implementations, the functions, acts or tasks noted in (e.g., indicated by) the blocks may occur out of the order noted in (e.g., indicated by) the flowcharts. For example, the functions, acts or tasks noted in two blocks shown in succession may be executed substantially simultaneously or concurrently, or the functions, acts or tasks noted in the blocks may be executed in the reverse order, depending upon the functions, acts or tasks involved.

Figure 2:
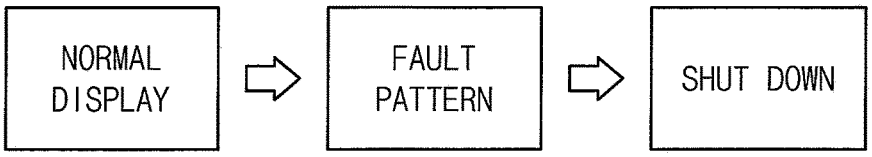
FIG. 2 is a diagram for describing an operation of a display apparatus according to example embodiments.

FIG. 1 is a block diagram illustrating a display apparatus according to example embodiments. FIG. 2 is a diagram for describing an operation of a display apparatus according to example embodiments.

Referring to FIGS. 1 and 2, a display apparatus 10 includes a display panel 100, a timing controller 200 and a power management integrated circuit (PMIC) 500. The display apparatus 10 may further include a gate driver 300 and a data driver 400.

The display panel 100 is to operate (e.g., display an image) based on output image data DAT. The display panel 100 is coupled (e.g., connected) to a plurality of gate lines GL and a plurality of data lines DL. The plurality of gate lines GL may extend in a first direction DR1, and the plurality of data lines DL may extend in a second direction DR2 crossing (e.g., substantially perpendicular to) the first direction DR1.

The display panel 100 includes a plurality of pixels PX that are arranged in a matrix formation. Each of the plurality of pixels PX may be electrically coupled (e.g., connected) to a respective one of the plurality of gate lines GL and a respective one of the plurality of data lines DL. The display panel 100 may include a display region including the plurality of pixels PX and a peripheral region surrounding the display region.

In some example embodiments, the display panel 100 may be a liquid crystal display (LCD) panel, and each of the plurality of pixels PX may be a pixel for the LCD panel that includes a liquid crystal and a driving transistor. In other example embodiments, the display panel 100 may be an organic light emitting display (OLED) panel, and each of the plurality of pixels PX may be a pixel for the OLED panel that includes an organic light emitting diode and a driving transistor. In still other example embodiments, the display panel 100 may be a micro light emitting diode (LED) display panel, an inorganic light emitting display panel or a quantum dot light emitting display (QLED) panel. However, example embodiments are not limited thereto, and the display panel 100 and the plurality of pixels PX may be implemented in various suitable ways.

In some example embodiments, the plurality of pixels PX may include a plurality of red pixels to output (e.g., emit) red light, a plurality of green pixels to output green light and a plurality of blue pixels to output blue light. In other example embodiments, the plurality of pixels PX may include a plurality of yellow pixels to output yellow light, a plurality of cyan pixels to output cyan light and a plurality of magenta pixels to output magenta light. In still other example embodiments, the plurality of pixels PX may further include a plurality of white pixels to output white light, or the plurality of pixels PX may include pixels to output light of other colors.

The timing controller 200 controls operations of the display panel 100, the gate driver 300, the data driver 400 and the PMIC 500. The timing controller 200 receives input image data IDAT and an input control signal ICONT from an external device (e.g., a host device or a graphic processor). The input image data IDAT may include a plurality of pixel data for the plurality of pixels PX. The input control signal ICONT may include a master clock signal, a data enable signal, a vertical synchronization signal, a horizontal synchronization signal, etc.

The timing controller 200 is to generate the output image data DAT based on the input image data IDAT. For example, the timing controller 200 may selectively perform (e.g., perform one or more from among) an image quality compensation, a spot compensation, an adaptive color correction (ACC) and/or a dynamic capacitance compensation (DCC) on the input image data DAT to generate the output image data DAT.

The timing controller 200 is to generate a first control signal for controlling the PMIC 500 and the gate driver 300 and a second control signal DCONT for controlling the data driver 400 based on the input control signal ICONT. For example, the first control signal may include a vertical start control signal STV, a gate clock control signal CPV, etc. The second control signal DCONT may include a horizontal start signal, a data clock signal, a polarity control signal, a data load signal, etc.

The PMIC 500 is to generate a first power supply voltage OV1 and a second power supply voltage OV2 based on an external power supply voltage VEXT. The first power supply voltage OV1 may be supplied or provided to the timing controller 200 and may be utilized to drive or operate the timing controller 200. The second power supply voltage OV2 may be supplied or provided to the data driver 400 and may be utilized to drive or operate the data driver 400.

The PMIC 500 is to generate a vertical start pulse STVP and a gate clock signal CKV based on the external power supply voltage VEXT, the vertical start control signal STV and the gate clock control signal CPV. The vertical start pulse STVP and the gate clock signal CKV may be supplied or provided to the gate driver 300 and may be utilized to drive or operate the gate driver 300. Although FIG. 1 illustrates one gate clock control signal CPV and one gate clock signal CKV, a plurality of gate clock signals may be generated based on a plurality of gate clock control signals according to example embodiments. In addition, an inverted gate clock signal having a phase opposite to that of the gate clock signal CKV may be generated together (e.g., the inverted gate clock signal and the gate clock signal CKV may be generated together).

The gate driver 300 is coupled (e.g., connected) to the display panel 100 through the plurality of gate lines GL. The gate driver 300 is to generate a plurality of gate signals GS to drive the display panel 100 based on the vertical start pulse STVP and the gate clock signal CKV. For example, the gate driver 300 may sequentially apply or provide the plurality of gate signals GS to the display panel 100 through the plurality of gate lines GL.

The data driver 400 is coupled (e.g., connected) to the display panel 100 through the plurality of data lines DL. The data driver 400 is to generate a plurality of data voltages DV (e.g., analog voltages) to drive the display panel 100 based on the output image data DAT (e.g., digital data) and the second control signal DCONT. For example, the data driver 400 may sequentially apply or provide the plurality of data voltages DV to a plurality of lines (e.g., horizontal lines) in the display panel 100 through the plurality of data lines DL.

In some example embodiments, the gate driver 300 may be an amorphous silicon gate (ASG) unit that is integrated at (e.g., on) the peripheral region of the display panel 100. In other example embodiments, the gate driver 300 may be disposed at any suitable region that is located outside the display panel 100.

In some example embodiments, the timing controller 200 and the PMIC 500 may be mounted on a printed circuit board (PCB), and the data driver 400 may be mounted on a flexible PCB (FPCB). For example, the FPCB may electrically couple (e.g., connect) the PCB with the display panel 100. For example, the PCB and the FPCB may be electrically coupled (e.g., connected) by an anisotropic conductive film (ACF), and the FPCB and the display panel 100 may be electrically coupled (e.g., connected) by an ACF.

In some example embodiments, the data driver 400 may be disposed, e.g., mounted or directly mounted, on the display panel 100, or may be coupled (e.g., connected) to the display panel 100 via a tape carrier package (TCP) (e.g., may be connected as a TCP type or manner). In some embodiments, the data driver 400 may be integrated on (e.g., integrated with) the display panel 100.

In the display apparatus 10 according to example embodiments, the PMIC 500 may be implemented by applying a sensing circuit technology. For example, the PMIC 500 may sense or detect various suitable parameters such as a voltage, a current, a temperature, a time, a data pattern, etc., and may perform a compensating or correcting operation (e.g., an operation of changing or varying a voltage level), a strengthening operation (e.g., an operation of updating data), a protecting operation (e.g., an operation of shutting down the display apparatus 10 and/or the display panel 100), etc. depending on occurred phenomenon when a specific phenomenon (e.g., an abnormality and/or a defective phenomenon) has occurred as a result of sensing or detecting. For example, the PMIC 500 may perform one or more operations in response to sensing an occurrence of one or more phenomenon, and the one or more operations may depend on (e.g., correspond to) the type or kind of the one or more phenomenon.

As described above, to shut down the display panel 100 by applying the sensing circuit technology when at least one selected from among a plurality of defective phenomena has occurred, the PMIC 500 monitors whether the plurality of defective phenomena have occurred. When the at least one selected from among the plurality of defective phenomena has occurred, the PMIC 500 stores fault data FD representing that the sensed defective phenomenon has occurred and shuts down the display panel 100. A more detailed configuration and operation of the PMIC 500 will be described with reference to FIG. 5.

In some example embodiments, the plurality of defective phenomena are not errors (or failures) associated with (or related to) electrical/physical connections between components included in the display apparatus 10, but are operating (or driving) errors that occur while the display panel 100 is driven. For example, the plurality of defective phenomena may include errors associated with operations of driving circuits (e.g., the timing controller 200, the gate driver 300, the data driver 400 and the PMIC 500) included in the display apparatus 10.

In some example embodiments, the PMIC 500 may shut down the display panel 100 by blocking (or cutting off) the first power supply voltage OV1 supplied to the timing controller 200. In other example embodiments, the PMIC 500 may shut down the display panel 100 by blocking the gate clock signal CKV supplied to the gate driver 300. In still other example embodiments, the PMIC 500 may shut down the display panel 100 by blocking the second power supply voltage OV2 supplied to the data driver 400. In some embodiments, the PMIC 500 may shut down the display panel 100 by substantially simultaneously or concurrently blocking two or more of the first power supply voltage OV1, the second power supply voltage OV2 and the gate clock signal CKV.

In the display apparatus 10 according to example embodiments, when shutting down the display panel 100 by applying the sensing circuit technology when at least one selected from among the plurality of defective phenomena has occurred, a fault pattern for recognizing (or identifying) that the defective phenomenon has occurred may be displayed on the display panel 100 before the display panel 100 is shut down. For example, as illustrated by "NORMAL DISPLAY" in FIG. 2, if no defective phenomenon occurs after the display apparatus 10 is powered on (or after power is supplied to the display apparatus 10), the display apparatus 10 and the display panel 100 may normally operate and may normally display an image. As illustrated by "FAULT PATTERN" in FIG. 2, if a specific defective phenomenon has occurred while the display apparatus 10 and/or the display panel 100 is driven, a fault pattern corresponding to the specific defective phenomenon may be displayed during a predetermined or set time interval such that it is notified (e.g., so as to provide notice) that the specific defective phenomenon has occurred. As illustrated by "SHUT DOWN" in FIG. 2, if the specific defective phenomenon has occurred, the display panel 100 may be shut down after the predetermined or set time interval has elapsed.

As described above, to display the fault pattern when at least one selected from among the plurality of defective phenomena has occurred and before the display panel 100 is shut down, the timing controller 200 stores a plurality of fault patterns to be displayed on the display panel 100, and the plurality of fault patterns are to be utilized to represent that the plurality of defective phenomena have occurred while the display panel 100 is driven. In some embodiments, a fault pattern of the plurality of fault patterns may be utilized to represent that a corresponding one of the plurality of defective phenomena have occurred. When the specific defective phenomenon has occurred and is sensed by the PMIC 500, the fault data FD stored in the PMIC 500 and representing that the specific defective phenomenon has occurred may be read (or retrieved), the fault pattern corresponding to the fault data FD may be read, fault image data FDAT corresponding to the read fault pattern may be generated, and the fault image data FDAT may be provided to the data driver 400 and the display panel 100. A more detailed configuration and operation of the timing controller 200 will be described with reference to FIG. 3.

Figure 3:
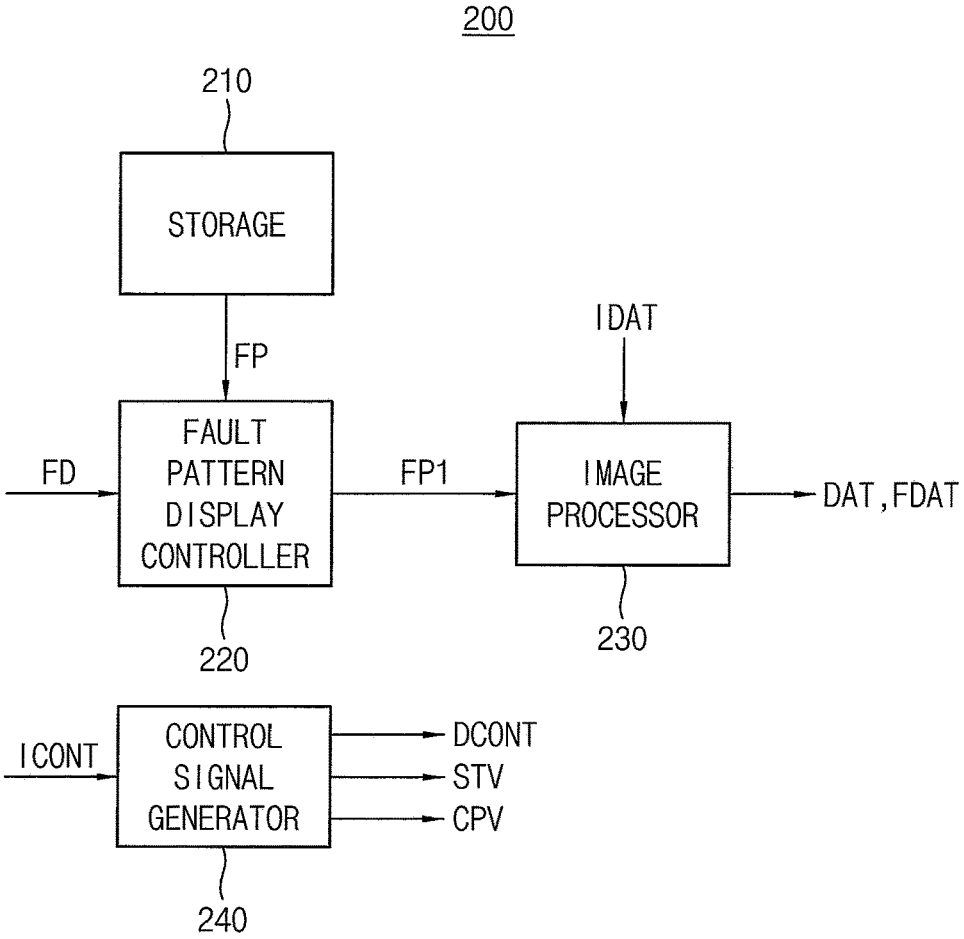
FIG. 3 is a block diagram illustrating an example of a timing controller included in a display apparatus according to example embodiments.
Figures 4, 5:
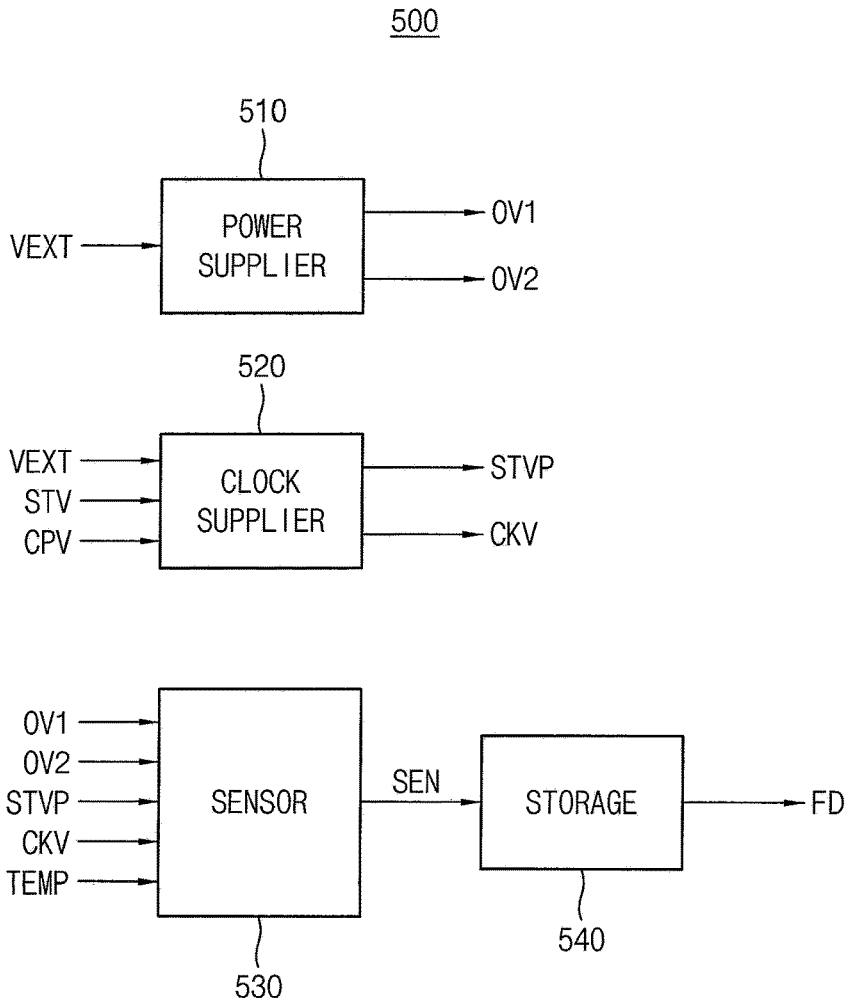
FIG. 4 is a diagram for describing an operation of a timing controller of FIG. 3.
FIG. 5 is a block diagram illustrating an example of a PMIC included in a display apparatus according to example embodiments.

FIG. 3 is a block diagram illustrating an example of a timing controller included in a display apparatus according to example embodiments. FIG. 4 is a diagram for describing an operation of a timing controller of FIG. 3.

Referring to FIGS. 3 and 4, the timing controller 200 may include a storage 210, a fault pattern display controller 220 and an image processor 230. The timing controller 200 may further include a control signal generator 240.

The storage 210 may store a plurality of fault patterns FP to be utilized to represent that the plurality of defective phenomena have occurred. For example, the storage 210 may include a buffer, a register and/or a memory. For example, the memory may include one or more various suitable nonvolatile memories such as an electrically erasable programmable read only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), and the like, and/or one or more various suitable volatile memories such as a dynamic random access memory (DRAM), a static random access memory (SRAM), and the like.

In some example embodiments, the plurality of defective phenomena may include at least one selected from among an over-current protection failure (or error), a zero-current detection failure, a temperature failure and a communication failure. For example, the over-current protection failure may be caused (or occurred) by an electrical short in line, the zero-current detection failure may be caused when a current leaks in a portion where the current should not flow, the temperature failure may be caused when a temperature of an inside of the display apparatus 10 and/or a temperature of a specific chip is out of a predetermined or set range, and the communication failure may be caused by an inter-integrated circuit (I2C) communication error between the timing controller 200 and another component (e.g., the PMIC 500).

In some example embodiments, when the plurality of defective phenomena include the over-current protection failure, the zero-current detection failure, the temperature failure and the communication failure, the plurality of fault patterns FP may include a first fault pattern FP1 to represent that an over-current protection failure FOCP has occurred, a second fault pattern FP2 to represent that a zero-current detection failure FZCD has occurred, a third fault pattern FP3 to represent that a temperature failure FTEMP has occurred and a fourth fault pattern FP4 to represent that a communication failure FI2C has occurred, as illustrated in FIG. 4. However, the present disclosure is not limited thereto, and the plurality of defective phenomena may further include various other defective phenomena that may occur while the display panel 100 is driven, and the number of the plurality of fault patterns FP may be changed. In some embodiments, the number of the plurality of fault patterns may equal the number of the plurality of defective phenomena.

In some example embodiments, the plurality of fault patterns FP may be substantially the same as any display patterns stored in advance to drive the display panel 100. In other example embodiments, the plurality of fault patterns FP may be dedicated patterns to represent only the plurality of defective phenomena. For example, the first fault pattern FP1 corresponding to the over-current protection failure FOCP may be a pattern to display (e.g., utilized to display) a white screen, and the third fault pattern FP3 corresponding to the temperature failure FTEMP may be a pattern to display a blue screen. However, example embodiments are not limited thereto.

When the specific defective phenomenon is sensed by the PMIC 500, the fault pattern display controller 220 may read the fault data FD representing that the specific defective phenomenon has occurred from the PMIC 500 and may read a specific fault pattern corresponding to the specific defective phenomenon from the storage 210 based on the fault data FD. Although FIG. 3 illustrates an example where the specific defective phenomenon is the over-current protection failure FOCP and the fault pattern display controller 220 reads the first fault pattern FP1 corresponding to the over-current protection failure FOCP from the storage 210, the present disclosure is not limited thereto.

The image processor 230 may generate the output image data DAT based on the input image data DAT and may generate the fault image data FDAT based on the specific fault pattern (e.g., based on the first fault pattern FP1). The output image data DAT and the fault image data FDAT may be provided to the display panel 100 through the data driver 400. The display panel 100 may display a normal image based on the output image data DAT as illustrated by "NORMAL DISPLAY" in FIG. 2, or may display the specific fault pattern based on the fault image data FDAT as illustrated by "FAULT PATTERN" in FIG. 2.

In some example embodiments, the image processor 230 may selectively perform (e.g., perform one or more from among) the image quality compensation, the spot compensation, the ACC and/or the DCC on the input image data IDAT.

The control signal generator 240 may generate the vertical start control signal STV, the gate clock control signal CPV and the second control signal DCONT based on the input control signal ICONT.

FIG. 5 is a block diagram illustrating an example of a PMIC included in a display apparatus according to example embodiments.

Referring to FIG. 5, the PMIC 500 may include a power supplier 510, a sensor 530 and a storage 540. The PMIC 500 may further include a clock supplier 520.

The power supplier 510 may generate the first power supply voltage OV1 and the second power supply voltage OV2 based on the external power supply voltage VEXT. For example, the power supplier 510 may include a voltage regulator such as a switching regulator, a linear regulator, or the like.

The clock supplier 520 may generate the vertical start pulse STVP and the gate clock signal CKV based on the external power supply voltage VEXT, the vertical start control signal STV and the gate clock control signal CPV. For example, the clock supplier 520 may include a start pulse generator and a level shifter.

The sensor 530 may monitor whether the plurality of defective phenomena have occurred. For example, the sensor 530 may receive the first power supply voltage OV1, the second power supply voltage OV2, the vertical start pulse STVP and the gate clock signal CKV and may sense whether a voltage abnormality and/or a current abnormality have occurred. Thus, the sensor 530 may include a voltage measurer (or meter) and/or a current measurer. For another example, the sensor 530 may receive a temperature signal TEMP and may sense whether a temperature abnormality has occurred. Thus, the sensor 530 may include a temperature sensor. In some embodiments, the sensor 530 may include a timer to measure a time or time interval, a pattern detector to detect a specific data pattern, or the like.

The sensor 530 may generate a sensing signal SEN indicating a result of the monitoring operation and/or the sensing operation. For example, when all of the plurality of defective phenomena are not sensed (e.g., when none of the plurality of defective phenomena are sensed), the sensing signal SEN may have a first logic level. When at least one selected from among the plurality of defective phenomena is sensed, the sensing signal SEN may have a second logic level.

When the at least one selected from among the plurality of defective phenomena (e.g., the specific defective phenomenon) is sensed by the sensor 530, the storage 540 may store the fault data FD representing that the specific defective phenomenon has occurred. The fault data FD stored in the storage 540 may be output based on (e.g., in response to) a request of the timing controller 200. For example, as with the storage 210 in FIG. 3, the storage 540 may include a buffer, a register and/or a memory, and the memory may include one or more various suitable nonvolatile memories such as an EEPROM, a flash memory, a PRAM, a RRAM, a NFGM, a PoRAM, a MRAM, a FRAM, and the like, and/or one or more various suitable volatile memories such as a DRAM, a SRAM, and the like.

Figure 6:
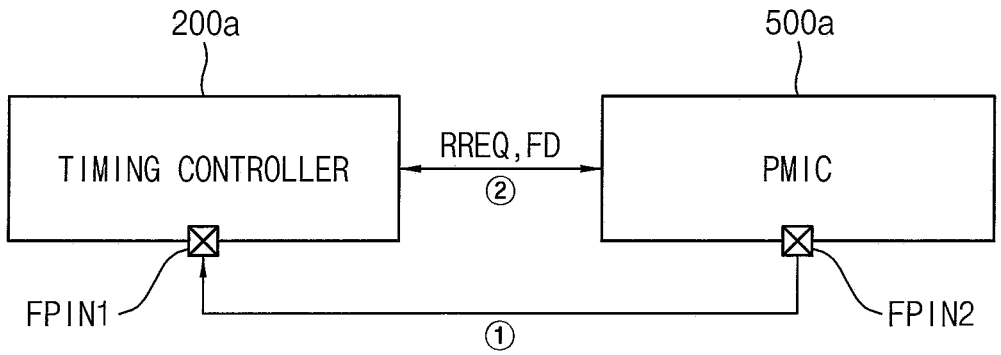
FIG. 6 is a block diagram illustrating an example of a timing controller and a PMIC included in a display apparatus according to example embodiments.

FIG. 6 is a block diagram illustrating an example of a timing controller and a PMIC included in a display apparatus according to example embodiments.

Referring to FIG. 6, a timing controller 200*a* may include a first fault detection pin FPIN1, and a PMIC 500*a* may include a second fault detection pin FPIN2.

The first and second fault detection pins FPIN1 and FPIN2 may be electrically coupled (e.g., connected) to each other. The first and second fault detection pins FPIN1 and FPIN2 may be pins newly added to the timing controller 200*a* and the PMIC 500*a*, not included in a conventional timing controller and a conventional PMIC. For example, a pin may be a contact pad or a contact pin, but the present disclosure is not limited thereto.

The timing controller 200*a* and the PMIC 500*a* may be the timing controller 200 and the PMIC 500 in FIG. 1, respectively. The timing controller 200*a* and the PMIC 500*a* may have substantially the same structures as those of the timing controller 200 of FIG. 3 and the PMIC 500 of FIG. 5, respectively. For example, the first fault detection pin FPIN1 may be coupled (e.g., connected) to the fault pattern display controller 220 in FIG. 3, and the second fault detection pin FPIN2 may be coupled (e.g., connected) to the sensor 530 in FIG. 5.

In an example of FIG. 6, the timing controller 200*a* may determine whether the specific defective phenomenon has occurred by utilizing the first fault detection pin FPIN1 and the second fault detection pin FPIN2.

For example, when the specific defective phenomenon is sensed by the sensor 530, the PMIC 500*a* may transition a voltage level of the second fault detection pin FPIN2 from a first level (e.g., a high level) to a second level (e.g., a low level), and the timing controller 200*a* may check through the first fault detection pin FPIN1 whether the voltage level of the second fault detection pin FPIN2 is transitioned from the first level to the second level (e.g., an operation ① in FIG. 6).

When it is checked by the timing controller 200*a* that the voltage level of the second fault detection pin FPIN2 is transitioned from the first level to the second level, the timing controller 200*a* may read the fault data FD, which corresponds to the specific defective phenomenon and is stored in the storage 540, from the PMIC 500*a* (e.g., an operation ② in FIG. 6). For example, the timing controller 200*a* may transmit (or transfer) a single read request RREQ to the PMIC 500*a*, and the PMIC 500*a* may transmit the fault data FD to the timing controller 200*a* in response to the read request RREQ. For example, a communication scheme between the timing controller 200*a* and the PMIC 500*a* may be an I2C communication.

Figure 7:
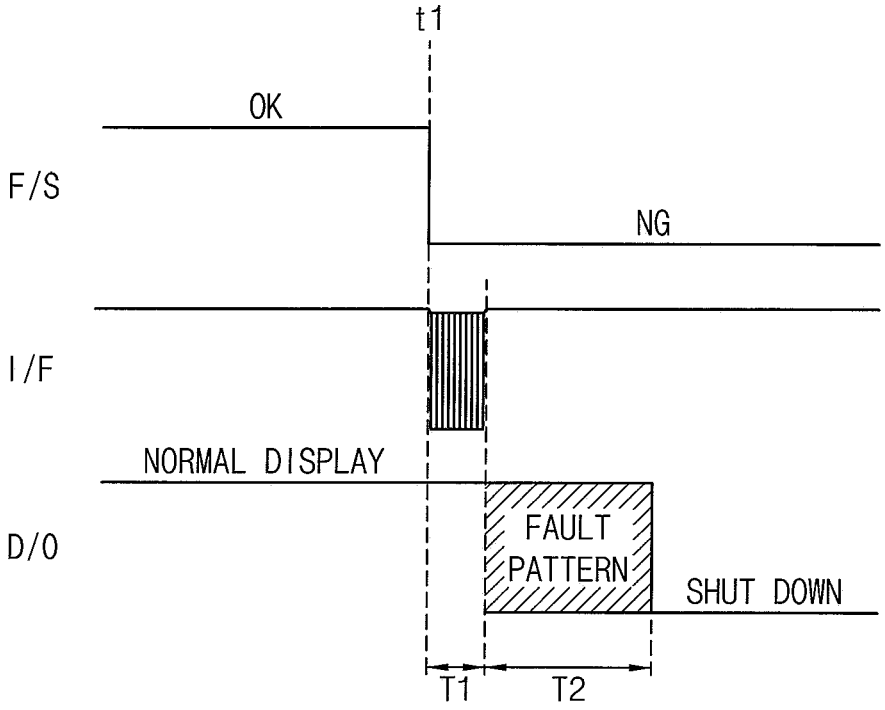
FIG. 7 is a timing diagram for describing an operation of a display apparatus according to example embodiments.

FIG. 7 is a timing diagram for describing an operation of a display apparatus according to example embodiments.

In FIG. 7, "F/S" indicates a fault status, "I/F" indicates an interface (e.g., the I2C communication) between the timing controller and the PMIC, and "D/O" indicates a display operation of the display panel 100.

Referring to FIG. 7, the specific defective phenomenon is sensed at a first time point t1. Thus, the fault status F/S may have a normal state OK before the first time point t1 and a fault state NG after the first time point t1. For example, a level of the sensing signal SEN in FIG. 5 and/or the voltage level of the second fault detection pin FPIN2 in FIG. 6 may correspond to the fault status F/S in FIG. 7.

The display panel 100 may not be immediately shut down immediately after the specific defective phenomenon is sensed (e.g., immediately after the first time point t1). The timing controller 200 may read the fault data FD, which represents that the specific defective phenomenon has occurred and is stored in the PMIC 500, from the PMIC 500 during a first time interval T1 after (e.g., immediately after) the specific defective phenomenon is sensed. Thus, as with before the specific defective phenomenon is sensed (e.g., as before the first time point t1), the display panel 100 may normally display an image even during the first time interval T1.

The timing controller 200 may generate the fault image data FDAT corresponding to the read fault data FD, and the display panel 100 may display the fault pattern corresponding to the specific defective phenomenon based on the fault image data FDAT during a second time interval T2 after the first time interval T1. The display panel 100 may be shut down after the second time interval T2. Thus, a delay corresponding to the sum of the first time interval T1 and the second time interval T2 may exist between a time point (e.g., the first time point t1) at which the specific defective phenomenon is sensed and a time point at which the display panel 100 is shut down.

In some example embodiments, the second time interval T2 may be substantially the same as a length (e.g., time duration) of one frame period in which the display panel 100 displays one frame image, or the second time interval T2 may be an integer multiple of the length of one frame period. The first time interval T1 may be shorter than the second time interval T2.

Figure 8:
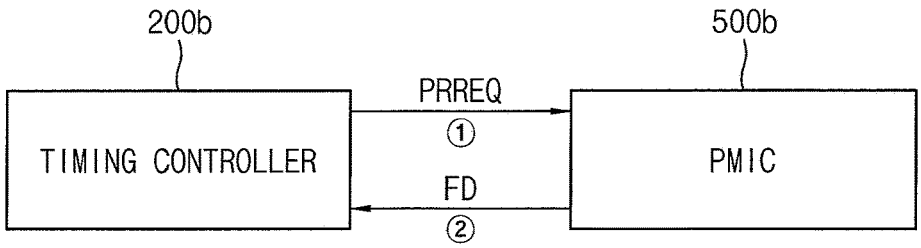
FIG. 8 is a block diagram illustrating another example of a timing controller and a PMIC included in a display apparatus according to example embodiments.

FIG. 8 is a block diagram illustrating another example of a timing controller and a PMIC included in a display apparatus according to example embodiments. Descriptions that are redundant of the descriptions corresponding to FIG. 6 may not be repeated.

Referring to FIG. 8, unlike the example of FIG. 6, each of a timing controller 200*b* and a PMIC 500*b* in FIG. 8 may not include a fault detection pin. The timing controller 200*b* and the PMIC 500*b* may be the timing controller 200 and the PMIC 500 in FIG. 1, respectively. The timing controller 200*b* and the PMIC 500*b* may have substantially the same structures as those of the timing controller 200 of FIG. 3 and the PMIC 500 of FIG. 5, respectively.

In an example of FIG. 8, the timing controller 200*b* may determine whether the specific defective phenomenon has occurred by periodically checking whether the PMIC 500*b* stores the fault data FD.

For example, the timing controller 200*b* may transmit a read request PRREQ to the PMIC 500*b* repeatedly (e.g., at every predetermined or set cycle), and thus may periodically check whether the PMIC 500*b* stores the fault data FD (e.g., ① in FIG. 8).

When the PMIC 500*b* senses the specific defective phenomenon and stores the fault data FD, the PMIC 500*b* may transmit the fault data FD to the timing controller 200*b* in response to the read request PRREQ of the timing controller 200*b*.

Figure 9:
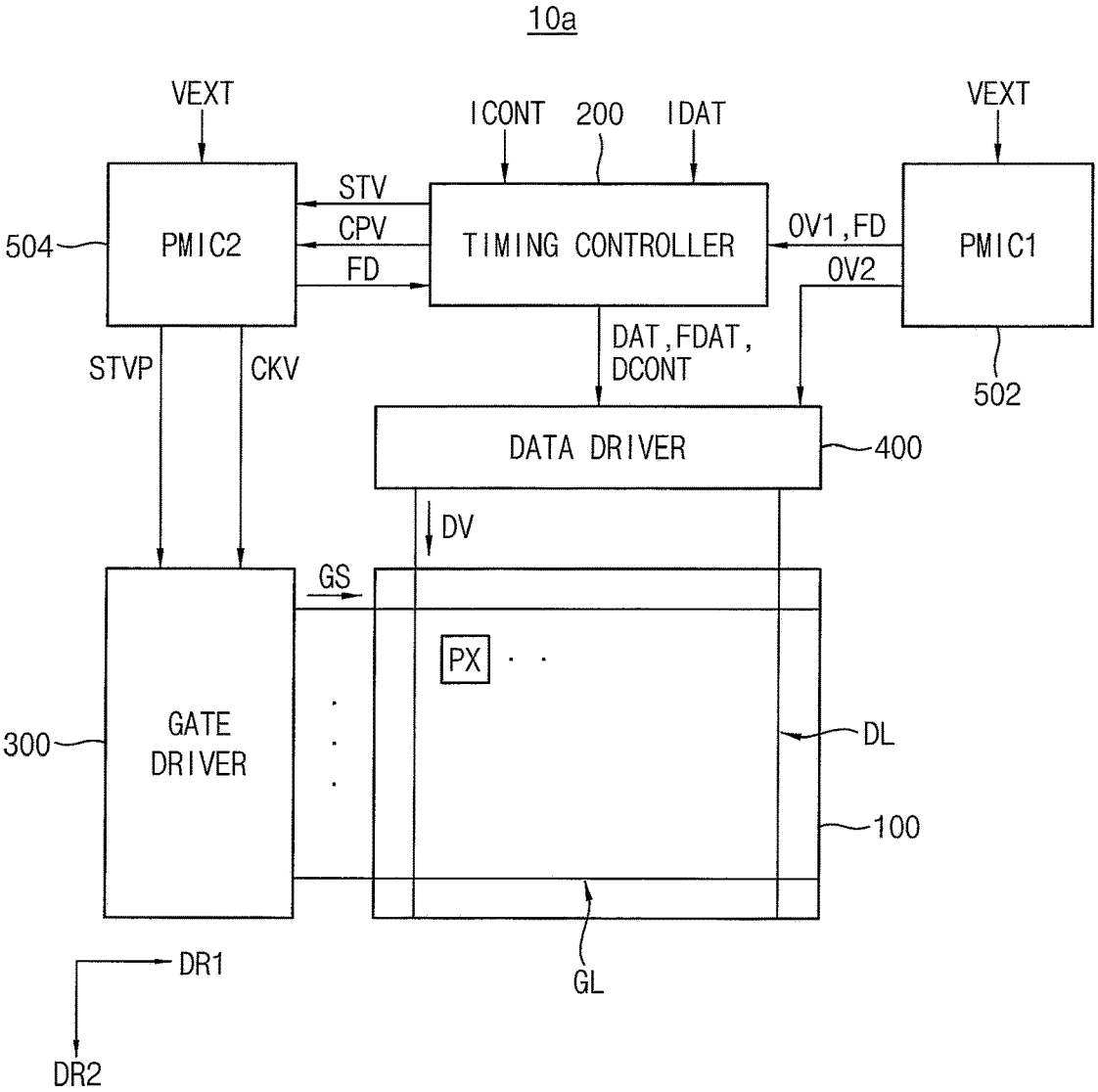
FIG. 9 is a block diagram illustrating a display apparatus according to example embodiments.

FIG. 9 is a block diagram illustrating a display apparatus according to example embodiments. Descriptions redundant of the descriptions corresponding to FIG. 1 may not be repeated.

Referring to FIG. 9, a display apparatus 10*a* includes a display panel 100, a timing controller 200, a first PMIC (PMIC1) 502 and a second PMIC (PMIC2) 504. The display apparatus 10*a* may further include a gate driver 300 and a data driver 400.

The display apparatus 10*a* of FIG. 9 may be substantially the same as the display apparatus 10 of FIG. 1, except that the display apparatus 10*a* includes two PMICs 502 and 504. The PMICs 502 and 504 may be implemented by dividing (or separating) the PMIC 500 in FIG. 1 into two components. For example, the PMICs 502 and 504 may collectively include components and perform functions that are substantially the same as, or similar to, all of the components and functions of the PMIC 500 illustrated in, and described with respect to, FIG. 1.

The first PMIC 502 is to generate the first power supply voltage OV1 and the second power supply voltage OV2 based on the external power supply voltage VEXT. The second PMIC 504 is to generate the vertical start pulse STVP and the gate clock signal CKV based on the external power supply voltage VEXT, the vertical start control signal STV and the gate clock control signal CPV. For example, the first PMIC 502 may include the power supplier 510 in FIG. 5, and the second PMIC 504 may include the clock supplier 520 in FIG. 5.

In addition, the first and second PMICs 502 and 504 monitor whether the plurality of defective phenomena have occurred. When the at least one selected from among the plurality of defective phenomena has occurred, the first and second PMICs 502 and 504 (e.g., the first and second PMICs 502 and 504 collectively) store the fault data FD representing that the sensed defective phenomenon has occurred and shut down the display panel 100. For example, each of the first and second PMICs 502 and 504 may include at least a part of the sensor 530 in FIG. 5 and may include the storage 540 in FIG. 5. In some example embodiments, the sensor 530 and the storage 540 in FIG. 5 may be included in only one of the first and second PMICs 502 and 504. In some example embodiments, the first and second PMICs 502 and 504 collectively include the sensor 530 and the storage 540 illustrated in, and described with respect to, FIG. 5.

Figure 10:
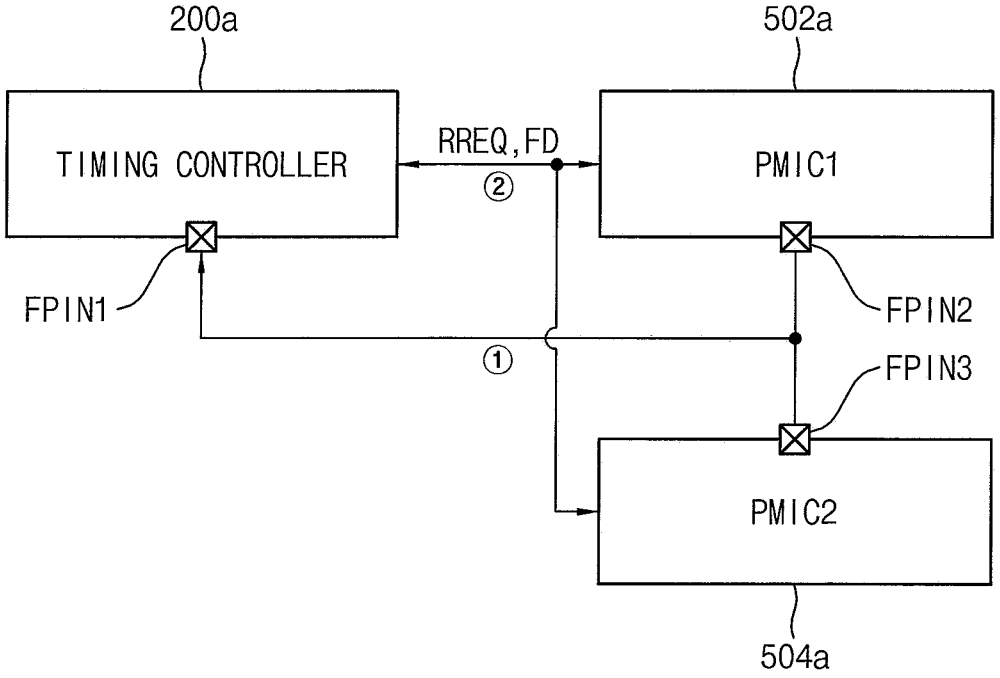
FIG. 10 is a block diagram illustrating still another example of a timing controller and a PMIC included in a display apparatus according to example embodiments.

FIG. 10 is a block diagram illustrating still another example of a timing controller and a PMIC included in a display apparatus according to example embodiments. Descriptions redundant of the descriptions corresponding to FIG. 6 may not be repeated.

Referring to FIG. 10, a timing controller 200*a* may include a first fault detection pin FPIN1, a first PMIC 502*a* may include a second fault detection pin FPIN2, and a second PMIC 504*a* may include a third fault detection pin FPIN3. The first, second and third fault detection pins FPIN1, FPIN2 and FPIN3 may be electrically coupled (e.g., connected) to each other.

The timing controller 200*a* may be the timing controller 200 in FIG. 9 and may have substantially the same structure as that of the timing controller 200 of FIG. 3. The first and second PMICs 502*a* and 504*a* may be the first and second PMICs 502 and 504 in FIG. 9, respectively, and may have (e.g., may collectively have) substantially the same structures as that of the PMIC 500 of FIG. 5. For example, each of the second and third fault detection pins FPIN2 and FPIN3 may be coupled (e.g., connected) to at least a part of the sensor 530 in FIG. 5.

In an example of FIG. 10, the timing controller 200*a* may determine whether the specific defective phenomenon has occurred by utilizing the first fault detection pin FPIN1, the second fault detection pin FPIN2 and the third fault detection pin FPIN3.

For example, when the specific defective phenomenon is sensed by the sensor 530, one of the first and second PMICs 502*a* and 504*a* may transition (e.g., may respectively transition) a voltage level of one of the second and third fault detection pins FPIN2 and FPIN3 from a first level to a second level. When the voltage level of one of the second and third fault detection pins FPIN2 and FPIN3 is transitioned, the voltage levels of both of the second and third fault detection pins FPIN2 and FPIN3 may be transitioned because the second and third fault detection pins FPIN2 and FPIN3 are electrically coupled (e.g., connected) to each other. The timing controller 200*a* may check, through the first fault detection pin FPIN1, whether the voltage levels of the second and third fault detection pins FPIN2 and FPIN3 are transitioned from the first level to the second level (e.g., ① in FIG. 10).

When it is checked, by the timing controller 200*a*, that the voltage levels of the second and third fault detection pins FPIN2 and FPIN3 are transitioned from the first level to the second level, the timing controller 200*a* may read the fault data FD, which corresponds to the specific defective phenomenon and is stored in the storage 540, from one of the first and second PMICs 502*a* and 504*a* (e.g., ② in FIG. 10).

In the example of FIG. 10, the second fault detection pin FPIN2 and the third fault detection pin FPIN3 may be electrically coupled (e.g., connected) to each other such that an operation of shutting down the display panel 100 is synchronized. As described above, the first and second PMICs 502*a* and 504*a* may perform different functions. For example, the first PMIC 502*a* may generate the power supply voltages OV1 and OV2, and the second PMIC 504*a* may generate the gate clock signal CKV. Thus, the second fault detection pin FPIN2 and the third fault detection pin FPIN3 may be electrically coupled (e.g., connected) to each other such that the power supply voltages OV1 and OV2 and the gate clock signal CKV supplied from the PMICs 502*a* and 504*a* are substantially simultaneously or concurrently blocked, thereby synchronizing the operation of shutting down the display panel 100.

Figure 11:
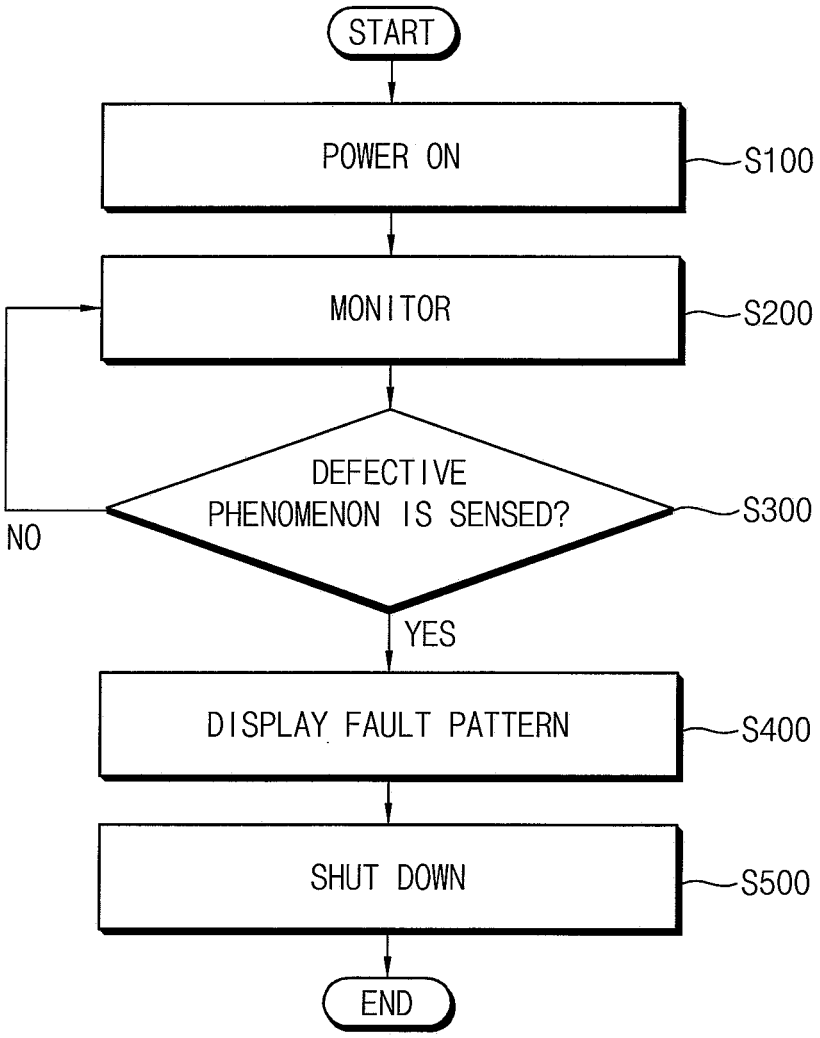
FIG. 11 is a flowchart illustrating a method of operating a display apparatus according to example embodiments.

FIG. 11 is a flowchart illustrating a method of operating a display apparatus according to example embodiments.

Referring to FIGS. 1 and 11, in a method of operating a display apparatus according to example embodiments, the display apparatus 10 is powered on or power is supplied to the display apparatus 10 (task S100). For example, the PMIC 500 may generate and supply the first power supply voltage OV1, the second power supply voltage OV2 and the gate clock signal CKV, and thus the display panel 100, the timing controller 200, the gate driver 300 and the data driver 400 may be powered on.

It is monitored, utilizing the PMIC 500, whether the plurality of defective phenomena have occurred (task S200). As described above, in some embodiments, the plurality of defective phenomena are not errors or failures associated with the electrical/physical connections between components included in the display apparatus 10, but may be operating or driving errors that occur while the display panel 100 is driven. For example, the plurality of defective phenomena may include errors associated with operations of driving circuits included in the display apparatus 10. However, the present disclosure is not limited thereto, and the plurality of defective phenomena may include other types or kinds of errors or failures.

When the specific defective phenomenon among the plurality of defective phenomena is sensed (task S300: YES), the specific fault pattern among the plurality of fault patterns is displayed on the display panel 100 (task S400). For example, the specific fault pattern among the plurality of fault patterns may be displayed on the display panel 100 after (e.g., in response to) the specific defective phenomenon among the plurality of defective phenomenon being sensed. In some embodiments, if the none of the plurality of defective phenomena are sensed, then the PMIC 500 continues to monitor whether the plurality of defective phenomena have occurred (task S200). The plurality of fault patterns are stored in the timing controller 200 and are utilized to represent that the plurality of defective phenomena have occurred while the display panel 100 is driven. In some embodiments, the plurality of fault patterns may be stored into the timing controller 200 in advance (e.g., during a manufacturing process). However, the present disclosure is not limited thereto, and the plurality fault patterns may be stored into the timing controller 200 at any suitable time. The specific fault pattern corresponds to the specific defective phenomenon. After the specific fault pattern is displayed on the display panel 100, the display panel 100 is shut down (task S500).

Figure 12:
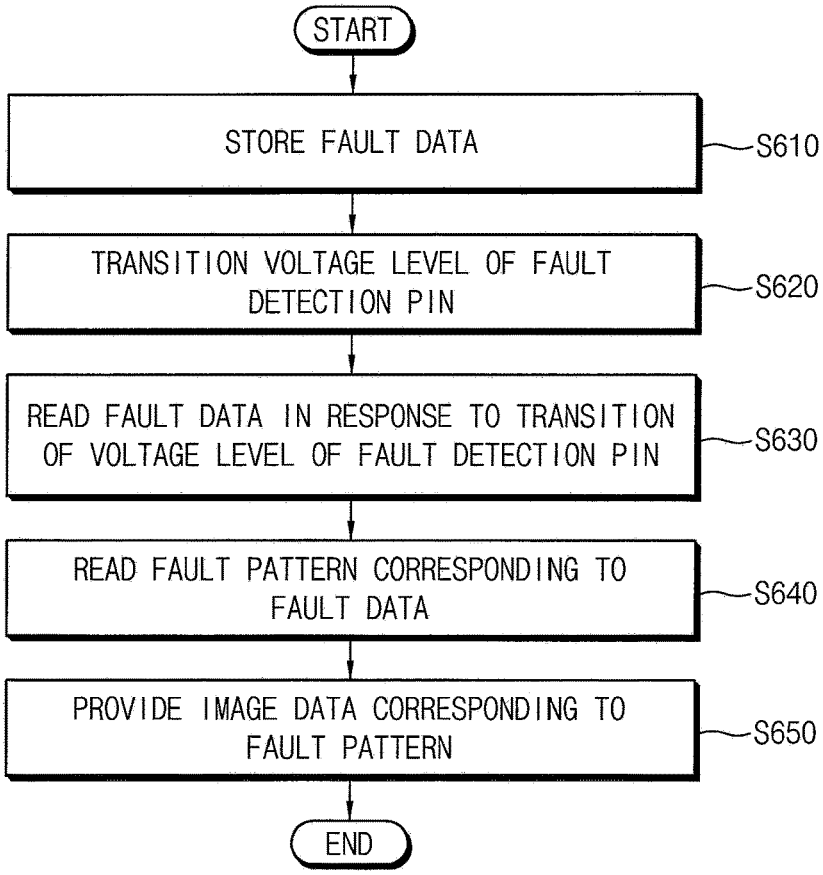
FIGS. 12 and 13 are flowcharts illustrating examples of displaying a fault pattern in a method of operating a display apparatus according to example embodiments.
Figure 13:
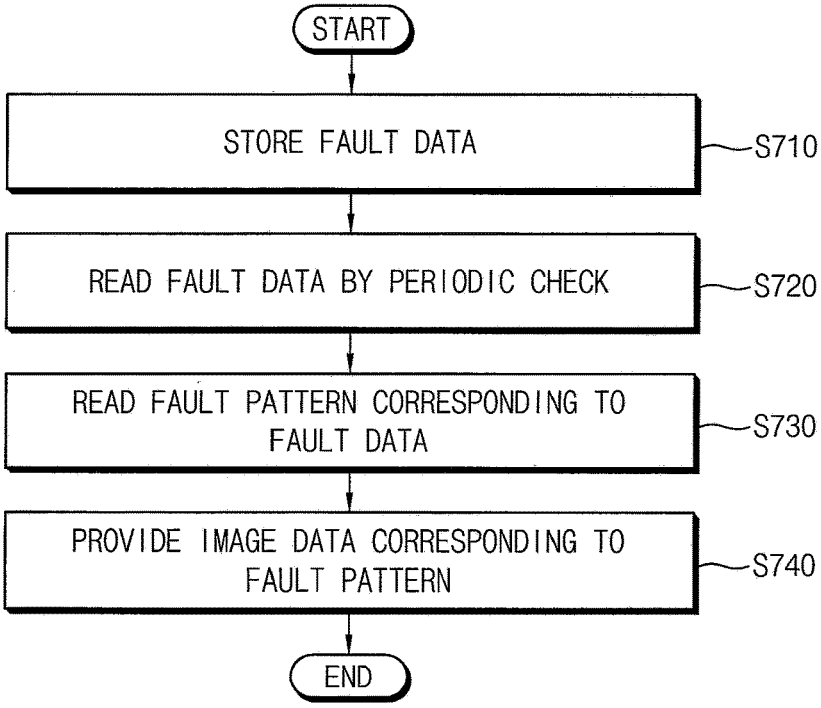

FIGS. 12 and 13 are flowcharts illustrating examples of displaying a fault pattern in a method of operating a display apparatus according to example embodiments.

Referring to FIGS. 1, 6, 11 and 12, when displaying the specific fault pattern on the display panel 100 (task S400), the timing controller 200*a* may include the first fault detection pin FPIN1, the PMIC 500*a* may include the second fault detection pin FPIN2, and the timing controller 200*a* may determine whether the specific defective phenomenon has occurred by utilizing the first and second fault detection pins FPIN1 and FPIN2.

For example, when the first defective phenomenon is sensed, the fault data FD representing that the specific defective phenomenon has occurred may be stored into the PMIC 500*a* (task S610), and the voltage level of the second fault detection pin FPIN2 of the PMIC 500*a* may be transitioned from the first level to the second level (task S620).

In addition, the timing controller 200*a* may check, through the first fault detection pin FPIN1, whether the voltage level of the second fault detection pin FPIN2 is transitioned from the first level to the second level (e.g., whether the voltage level of the second fault detection pin FPIN2 is at the second level), and may read the fault data FD from the PMIC 500*a* when (e.g., in response to determining that) the voltage level of the second fault detection pin FPIN2 is transitioned from the first level to the second level (task S630). The timing controller 200*a* may read the specific fault pattern corresponding to the specific defective phenomenon based on the read fault data FD (task S640), may generate the fault image data FDAT corresponding to the specific fault pattern, and may provide the fault image data FDAT corresponding to the specific fault pattern to the data driver 400 and the display panel 100 (task S650). In some embodiments, the timing controller 200*a* may provide the fault image data FDAT corresponding to the specific fault pattern to the data driver 400 and the display panel 100 by generating the fault image data FDAT.

When the PMIC is divided into two PMICs as described with reference to FIGS. 9 and 10, an operation of displaying the specific fault pattern may be performed similarly to the operation described with reference to FIG. 12.

Referring to FIGS. 1, 8, 11 and 13, in some embodiments, when displaying the specific fault pattern on the display panel 100 (task S400), each of the timing controller 200*b* and the PMIC 500*b* do not include the fault detection pin, and the timing controller 200*b* may determine whether the specific defective phenomenon has occurred by periodically checking whether the PMIC 500*b* stores the fault data FD.

For example, when the first defective phenomenon is sensed, the fault data FD representing that the specific defective phenomenon has occurred may be stored into the PMIC 500*b* (task S710). Task S710 may be substantially the same as task S610 in FIG. 12.

When the PMIC 500*b* senses the specific defective phenomenon and stores the fault data FD, the timing controller 200*b* may read the fault data FD from the PMIC 500*b* by (or during) a periodic check operation for the PMIC 500*b* (task S720).

The timing controller 200*b* may read the specific fault pattern corresponding to the specific defective phenomenon based on the read fault data FD (task S730), may generate the fault image data FDAT corresponding to the specific fault pattern, and may provide the fault image data FDAT corresponding to the specific fault pattern to the data driver 400 and the display panel 100 (task S740). Tasks S730 and S740 may be substantially the same as tasks S640 and S650 in FIG. 12, respectively.

The present disclosure may be applied to various suitable devices and/or systems including the display apparatus. For example, the present disclosure may be applied to systems such as a personal computer (PC), a workstation, a mobile phone, a smart phone, a tablet computer, a laptop computer, a personal digital assistant (PDA), a portable multimedia player (PMP), a digital camera, a portable game console, a music player, a camcorder, a video player, a navigation device, a wearable device, an internet of things (IoT) device, an internet of everything (IoE) device, an e-book reader, a virtual reality (VR) device, an augmented reality (AR) device, a robotic device, a drone, etc.

The apparatus, controller, circuit and/or any other relevant devices or components according to embodiments of the present invention described herein may be implemented utilizing any suitable hardware, firmware (e.g. an application-specific integrated circuit), software, or a combination of software, firmware, and hardware. For example, the various components of the apparatus may be formed on one integrated circuit (IC) chip or on separate IC chips. Further, the various components of the apparatus may be implemented on a flexible printed circuit film, a tape carrier package (TCP), a printed circuit board (PCB), or formed on one substrate. Further, the various components of the apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of example embodiments, and the present disclosure is not to be construed as limited thereto. Although some example embodiments have been described, those of ordinary skill in the art will readily appreciate that many suitable modifications are possible in the example embodiments without materially departing from the spirit and scope of the present disclosure. Accordingly, all such modifications are intended to be included within the scope of the present disclosure as defined in the claims and equivalents thereof. Therefore, it is to be understood that the foregoing is illustrative of various example embodiments and the present disclosure is not to be construed as limited to the example embodiments disclosed, and that suitable modifications to the disclosed example embodiments, as well as other example embodiments, are intended to be included within the scope of the appended claims and equivalents thereof.

What is claimed is:

1. A display apparatus comprising:

a display panel including a plurality of pixels;

a timing controller configured to control an operation of the display panel and to store a plurality of fault patterns to be displayed on the display panel, the plurality of fault patterns to be utilized to represent that a plurality of defective phenomena have occurred while the display panel is driven;

a power management integrated circuit (PMIC) configured to supply a first power supply voltage to the timing controller and to monitor whether the plurality of defective phenomena have occurred; and a gate driver coupled to a plurality of gate lines of the display panel, and configured to generate a plurality of gate signals based on a gate clock signal and to apply the plurality of gate signals to the plurality of gate lines, wherein, when a first defective phenomenon among the plurality of defective phenomena is sensed, the PMIC is configured to store first fault data representing that the first defective phenomenon has occurred and to shut down the display panel, wherein, when the first defective phenomenon is sensed, the timing controller is configured to control the display panel to display a first fault pattern corresponding to the first defective phenomenon among the plurality of fault patterns before the display panel is shut down by the PMIC, and wherein the PMIC is configured to supply the gate clock signal to the gate driver.

2. The display apparatus of claim 1, wherein the timing controller includes:

a storage configured to store the plurality of fault patterns;

a fault pattern display controller configured to read the first fault data, representing that the first defective phenomenon has occurred, from the PMIC and to read the first fault pattern, corresponding to the first defective phenomenon, from the storage based on the first fault data when the first defective phenomenon is sensed; and an image processor configured to generate image data corresponding to the first fault pattern.

3. The display apparatus of claim 2, wherein the PMIC includes:

a power supplier configured to generate the first power supply voltage based on an external power supply voltage;

a sensor configured to monitor whether the plurality of defective phenomena have occurred; and a storage configured to store the first fault data when the first defective phenomenon is sensed.

4. The display apparatus of claim 1, wherein:

the timing controller includes a first fault detection pin, the PMIC includes a second fault detection pin, and the timing controller is configured to determine whether the first defective phenomenon has occurred by utilizing the first fault detection pin and the second fault detection pin.

5. The display apparatus of claim 4, wherein:

when the first defective phenomenon is sensed, the PMIC is configured to transition a voltage level of the second fault detection pin from a first level to a second level, and the timing controller is configured to check through the first fault detection pin whether the voltage level of the second fault detection pin is at the second level, and to read the first fault data from the PMIC when the voltage level of the second fault detection pin is at the second level.

6. The display apparatus of claim 4, further comprising:

a second PMIC including a third fault detection pin and configured to generate a gate clock signal, wherein the second fault detection pin and the third fault detection pin are electrically coupled to each other such that an operation of shutting down the display panel is synchronized.

7. The display apparatus of claim 1, wherein the timing controller is configured to determine whether the first defective phenomenon has occurred by periodically checking whether the PMIC stores the first fault data.

8. The display apparatus of claim 7, wherein the timing controller is configured to read the first fault data from the PMIC when the PMIC senses the first defective phenomenon and stores the first fault data.

9. The display apparatus of claim 1, wherein:

the display panel is configured to not be shut down immediately after the first defective phenomenon is sensed, the timing controller is configured to read the first fault data from the PMIC during a first time interval immediately after the first defective phenomenon is sensed, and the display panel is configured to display the first fault pattern during a second time interval after the first time interval and to be shut down after the second time interval.

10. A display apparatus comprising:

a display panel including a plurality of pixels;

a timing controller configured to control an operation of the display panel and to store a plurality of fault patterns to be displayed on the display panel, the plurality of fault patterns to be utilized to represent that a plurality of defective phenomena have occurred while the display panel is driven; and a power management integrated circuit (PMIC) configured to supply a first power supply voltage to the timing controller and to monitor whether the plurality of defective phenomena have occurred, wherein, when a first defective phenomenon among the plurality of defective phenomena is sensed, the PMIC is configured to store first fault data representing that the first defective phenomenon has occurred and to shut down the display panel, wherein, when the first defective phenomenon is sensed, the timing controller is configured to control the display panel to display a first fault pattern corresponding to the first defective phenomenon among the plurality of fault patterns before the display panel is shut down by the PMIC, wherein the PMIC is configured to shut down the display panel by blocking the first power supply voltage to be supplied to the timing controller.

11. The display apparatus of claim 1, wherein the PMIC is configured to shut down the display panel by blocking the gate clock signal to be supplied to the gate driver.

12. The display apparatus of claim 1, further comprising:

a data driver coupled to a plurality of data lines of the display panel, and configured to generate a plurality of data voltages based on output image data provided from the timing controller and to apply the plurality of data voltages to the plurality of data lines, and wherein the PMIC is configured to supply a second power supply voltage to the data driver.

13. The display apparatus of claim 12, wherein the PMIC is configured to shut down the display panel by blocking the second power supply voltage to be supplied to the data driver.

14. The display apparatus of claim 1, wherein the plurality of defective phenomena include at least one selected from among an over-current protection failure, a zero-current detection failure, a temperature failure and a communication failure.

15. A method of operating a display apparatus, the method comprising:

supplying power to the display apparatus including a display panel, a timing controller and a power management integrated circuit (PMIC), the display panel including a plurality of pixels, the timing controller being to control an operation of the display panel and to store a plurality of fault patterns to be displayed on the display panel, the plurality of fault patterns to be utilized to represent that a plurality of defective phenomena have occurred while the display panel is driven;

monitoring, by the PMIC, whether the plurality of defective phenomena have occurred;

when a first defective phenomenon among the plurality of defective phenomena is sensed, displaying a first fault pattern among the plurality of fault patterns on the display panel, the first fault pattern corresponding to the first defective phenomenon; and after the first fault pattern is displayed on the display panel, shutting down the display panel, wherein:

the display panel is configured to not be shut down immediately after the first defective phenomenon is sensed, the timing controller is configured to read first fault data from the PMIC during a first time interval immediately after the first defective phenomenon is sensed, and the display panel is configured to display the first fault pattern during a second time interval after the first time interval and to be shut down after the second time interval.

16. The method of claim 15, wherein:

the timing controller includes a first fault detection pin, the PMIC includes a second fault detection pin, and the timing controller is to determine whether the first defective phenomenon has occurred by utilizing the first fault detection pin and the second fault detection pin.

17. The method of claim 16, wherein displaying the first fault pattern on the display panel includes:

when the first defective phenomenon is sensed, storing the first fault data representing that the first defective phenomenon has occurred into the PMIC;

when the first defective phenomenon is sensed, transitioning a voltage level of the second fault detection pin from a first level to a second level;

checking, through the first fault detection pin, whether the voltage level of the second fault detection pin is at the second level;

when the voltage level of the second fault detection pin is at the second level, reading the first fault data from the PMIC;

reading the first fault pattern corresponding to the first defective phenomenon based on the first fault data; and generating image data corresponding to the first fault pattern and providing the image data to the display panel.

18. The method of claim 15, wherein the timing controller is to determine whether the first defective phenomenon has occurred by periodically checking whether the PMIC stores the first fault data representing that the first defective phenomenon has occurred.

19. The method of claim 18, wherein displaying the first fault pattern on the display panel includes:

when the first defective phenomenon is sensed, storing the first fault data into the PMIC;

when the first defective phenomenon is sensed and when the first fault data is stored into the PMIC, reading the first fault data from the PMIC;

reading the first fault pattern corresponding to the first defective phenomenon based on the first fault data; and generating image data corresponding to the first fault pattern and providing the image data to the display panel.

* * * * *